US010596616B2

(12) United States Patent
Sonntag

(10) Patent No.: US 10,596,616 B2
(45) Date of Patent: Mar. 24, 2020

(54) FOLDING TOOL, FOLDING METHOD AND FOLDING DEVICE

(71) Applicant: KUKA SYSTEMS GMBH, Augsburg (DE)

(72) Inventor: Toni Sonntag, Augsburg (DE)

(73) Assignee: KUKA SYSTEMS GMBH, Augsburg (DE)

( * ) Notice: Subject to any disclaimer, the term of this patent is extended or adjusted under 35 U.S.C. 154(b) by 272 days.

(21) Appl. No.: 15/531,945

(22) PCT Filed: Dec. 3, 2015

(86) PCT No.: PCT/EP2015/078491
§ 371 (c)(1),
(2) Date: May 31, 2017

(87) PCT Pub. No.: WO2016/087572
PCT Pub. Date: Jun. 9, 2016

(65) Prior Publication Data

US 2017/0333974 A1 Nov. 23, 2017

(30) Foreign Application Priority Data

Dec. 4, 2014 (DE) ..... 20 2014 105 862 U

(51) Int. Cl.
*B21D 39/02* (2006.01)
*B21D 19/08* (2006.01)

(52) U.S. Cl.
CPC ..... *B21D 39/021* (2013.01); *B21D 19/08* (2013.01)

(58) Field of Classification Search
CPC ..... B21D 19/08; B21D 39/021; B21D 39/02
See application file for complete search history.

(56) References Cited

U.S. PATENT DOCUMENTS

| | | | | |
|---|---|---|---|---|
| 1,636,803 | A | 7/1927 | Brown | |
| 8,100,133 | B2 * | 1/2012 | Mintz | B25J 9/0084 128/898 |
| 8,127,423 | B2 * | 3/2012 | Toeniskoetter | B21D 39/021 29/243.58 |
| 8,914,964 | B2 * | 12/2014 | Hasegawa | B21D 39/021 29/243.5 |
| 2004/0187542 | A1 | 9/2004 | Golovashchenko et al. | |
| 2005/0086989 | A1 * | 4/2005 | Holmgren | B21D 39/021 72/220 |
| 2012/0291508 | A1 * | 11/2012 | Hasegawa | B21D 39/021 72/214 |

FOREIGN PATENT DOCUMENTS

| | | |
|---|---|---|
| DE | 200 04 498 U1 | 9/2001 |
| DE | 102 21 991 A1 | 11/2003 |
| FR | 2 708 491 A1 | 2/1995 |

(Continued)

*Primary Examiner* — Teresa M Ekiert
(74) *Attorney, Agent, or Firm* — McGlew and Tuttle, P.C.

(57) ABSTRACT

A folding tool (2) and a method for bend folding a workpiece (5) in multiple steps. The folding tool (2) includes three or more driven folding elements (13, 17, 21) which are positioned above one another and are fed to a common folding point, at least one folding element (17, 21) performing a swiveling movement. The folding tool (2) is used for successively creating folds with fold angles of about 160° or more in a plurality of folding steps.

19 Claims, 8 Drawing Sheets

(56) References Cited

FOREIGN PATENT DOCUMENTS

| | | | |
|---|---|---|---|
| JP | H04 266433 | A | 9/1992 |
| JP | H09 262624 | A | 10/1997 |
| JP | 2005 240083 | A | 9/2005 |
| WO | 89/09101 | A1 | 10/1989 |
| WO | 98/02260 | A1 | 1/1998 |
| WO | 99/37419 | A1 | 7/1999 |

* cited by examiner

FOLDING TOOL, FOLDING METHOD AND FOLDING DEVICE

CROSS REFERENCE TO RELATED APPLICATIONS

This application is a United States National Phase Application of International Application PCT/EP2015/078491, filed Dec. 3, 2015, and claims the benefit of priority under 35 U.S.C. § 119 of German Application 20 2014 105 862.1, filed Dec. 4, 2014, the entire contents of which are incorporated herein by reference.

FIELD OF THE INVENTION

The present invention pertains to a folding tool, to a folding method and to a folding device having a plurality of driven folding elements, which can be fed to a common folding point.

BACKGROUND OF THE INVENTION

Such a folding tool for bend folding a workpiece in two steps is known from WO 99/37419 A. The folding or hemming tool has two driven folding elements for prefolding and finish folding, which can be fed to a common folding point on the workpiece. The two folding elements are configured as prefolding and finish folding knives and are arranged on a rotatable folding head.

Another version of such a folding tool with two folding elements is known from DE 200 04 498 U1.

WO 98/02260 discloses a folding tool, in which a plurality of folding elements driven jointly from a central point are fed to different folding points at a workpiece.

SUMMARY OF THE INVENTION

An object of the present invention is to provide an improved folding technique.

The folding technique according to the invention, i.e., the folding tool and the folding method as well as the folding device, have various technical and economic advantages.

On the one hand, the fold angle can be markedly increased due to the three or more folding elements at the folding tool. Fold angles of 160° and greater can be formed by a single folding tool. This can take place in a single cycle or folding operation. The workpiece can retain its position for this. The folding technique according to the invention has a very high performance and is cost-effective. It requires a low design effort and uncomplicated control as well as a small space.

On the other hand, the folding process can be carried out very rapidly and reliably as well as in a single clamping. The bending or folding operation takes place rapidly, and the fold or flange of the workpiece is deformed plastically and without disturbing rebounding into the final position. An overload on the material of the workpiece during the bending or folding operation as well defects resulting therefrom, e.g., flow marks, can be avoided.

The folding elements can be fed to the common folding points consecutively in three or more folding steps and they bend the fold or flange of the workpiece in the process step by step until the desired final angle is reached. The flange or fold is bent in the same direction each time during the consecutive folding steps. This folding process can be carried out with high precision. The folding steps follow one another rapidly, and, on the other hand, the time during which the respective folding element meshes with the fold or flange of the piece is long enough to achieve the desired permanent deformation.

Reclamping of the workpiece and dividing of the folding process among a plurality of different folding tools or folding devices and the inaccuracies associated herewith are unnecessary. The folding technique according to the invention is markedly more rapid, has a higher performance and is more cost-effective than the state of the art. This also has a favorable effect on the integration in a cyclically operating manufacturing plant, e.g., in the manufacture of vehicle body shells.

The folding elements may have a common drive. This may be configured as a consecutive drive (also known as a slave drive) and ensure the rapid and precise motion and feed sequence of the folding elements. The folding elements may also be removed from the folding point after their respective folding step. The three or more folding elements can move as a result without collisions and in a defined motion sequence. It is, in addition, advantageous in this connection if the folding elements are each mounted in an independently movable manner.

The folding elements may have different kinematics, with, e.g., the prefolding element performing a linear pushing motion, the intermediate folding element performing a multiaxial pivoting motion as well as the finish folding element performing a pivoting motion. The bearings of the folding elements have corresponding configurations for this.

In an especially favorable configuration, the drive has a rotating drive shaft and a transmission for transmitting the drive to the folding elements. The step sequence and motion sequence as well as the evading or retracting motion of the folding elements can also be controlled via the transmission. Such a drive configuration has special advantages in terms of the performance capacity and the low design effort. A 360° rotation of the drive shaft is sufficient for the folding process. At the end of the drive shaft, the folding tool automatically assumes the starting position again, in which all folding elements are in a retracted position and make it possible to change the workpiece without collisions. In addition, the control is substantially simplified. A transmission configuration in the form of a connecting rod mechanism has special advantages in this connection for the defined kinematics and motion sequences as well as for positions and orientations of the folding elements.

It is advantageous for the kinematics of the transmission and the optimization of the performance capacity and of the folding forces of the folding tool if the transmission is divided into a plurality of transmission groups, a separate transmission group being preferably associated with each folding element. The direct coupling of at least two transmission groups is favorable as well. This offers advantages for the accurate control and coordination of the step and motion sequence of the folding elements and for the folding forces that can be applied. A coupling of the transmission groups for an intermediate folding element and a finish folding element is especially favorable in this connection. Strong folding forces are made possible by the transmission groups being configured as respective toggle mechanisms.

Due to the transmission, the folding tool according to the invention also has advantages in terms of operational reliability, reduced wear and energy consumption. The transmission may, in addition, advantageously be used to actuate and control the mounting of a folding element, especially a multiaxially movable drag/sliding bearing. The energy needed for driving is supplied by the common drive for all motions of the different folding tool parts. A single drive device, which may have any desired and suitable configuration, e.g., as a controllable or regulatable electric motor, is sufficient.

The present invention is schematically shown in the drawings as an example. The present invention is described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
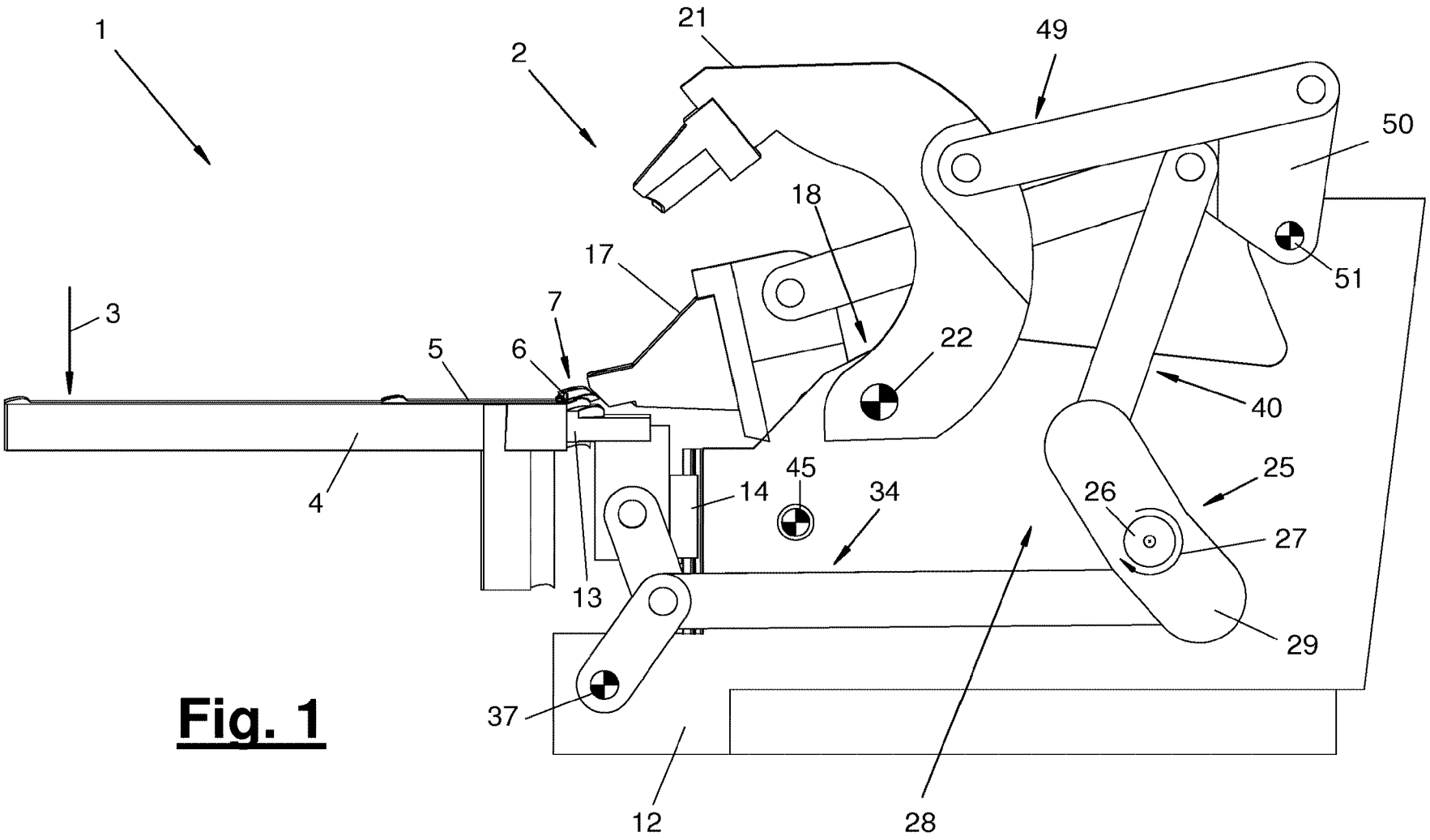
FIG. 1 is a lateral view of a folding tool and parts of a folding device.

Referring to the drawings, the present invention pertains to a folding tool (2) for bend folding a flange or fold (6) in multiple steps on a workpiece (5). The present invention further pertains to a folding device (1) with one or more such folding tools (2) as well as to a folding method.

The workpiece (5) preferably has a thin-walled configuration and consists of metal. It may have one layer or be multilayered. An additional workpiece part (5') can be clamped in with a bent fold (6) according to FIGS. 2 and 10. The additional workpiece part (5') lies on the workpiece (5) and the plastically deformed fold (6) extends over it during the bend folding in the final position of the fold and is clamped against the workpiece (5).

In the exemplary embodiments shown, the workpiece (5) is a sheet metal part consisting of steel. The workpiece (5) may be used for any desired purpose. The workpieces are preferably sheet metal parts for manufacturing vehicle body shells. The fold or flange (6) is formed in a projecting manner, e.g., at the outer edge of a workpiece (5).

In a schematic and cut-away view, FIG. 1 shows a folding device (1) with a corresponding folding tool (2). The folding tool (2) acts on a folding point (7) on the workpiece (5) and on the fold (6) thereof. The folding tool (2) may be present as a plurality of folding tools and at different points on the periphery of the workpiece. The configuration and the function of the folding tool (2) will be explained below.

The folding device (1) may further have a workpiece support (4), especially a folding bed, on which the workpiece (5) lies and is guided in a suitable manner. The position of the workpiece is preferably horizontal. The folding tool (2) may further have a holding-down device (3), e.g., a clamping device, for the workpiece (5). The holding-down device (3) may have any desired configuration and may be present as a plurality of holding-down devices. It is symbolized by an arrow in FIG. 1 for the sake of clarity.

The folding tool (2) is used for bend folding the workpiece (5) or the fold (6) in multiple steps. The bend folding takes place in three or more steps. The flange or fold (6) is always bent in the same direction during the consecutive folding steps or steps. Different bending positions of the fold (6) are shown for this in FIG. 2.

The folding tool (2) has three or more driven folding elements (13, 17, 21). The fold (6) can be bent by a fold angle ($\alpha$) of, e.g., 160° and more with the folding tool (2). The fold angle ($\alpha$) may also be smaller depending on the configuration and the setting of the folding tool (2).

Figure 2:
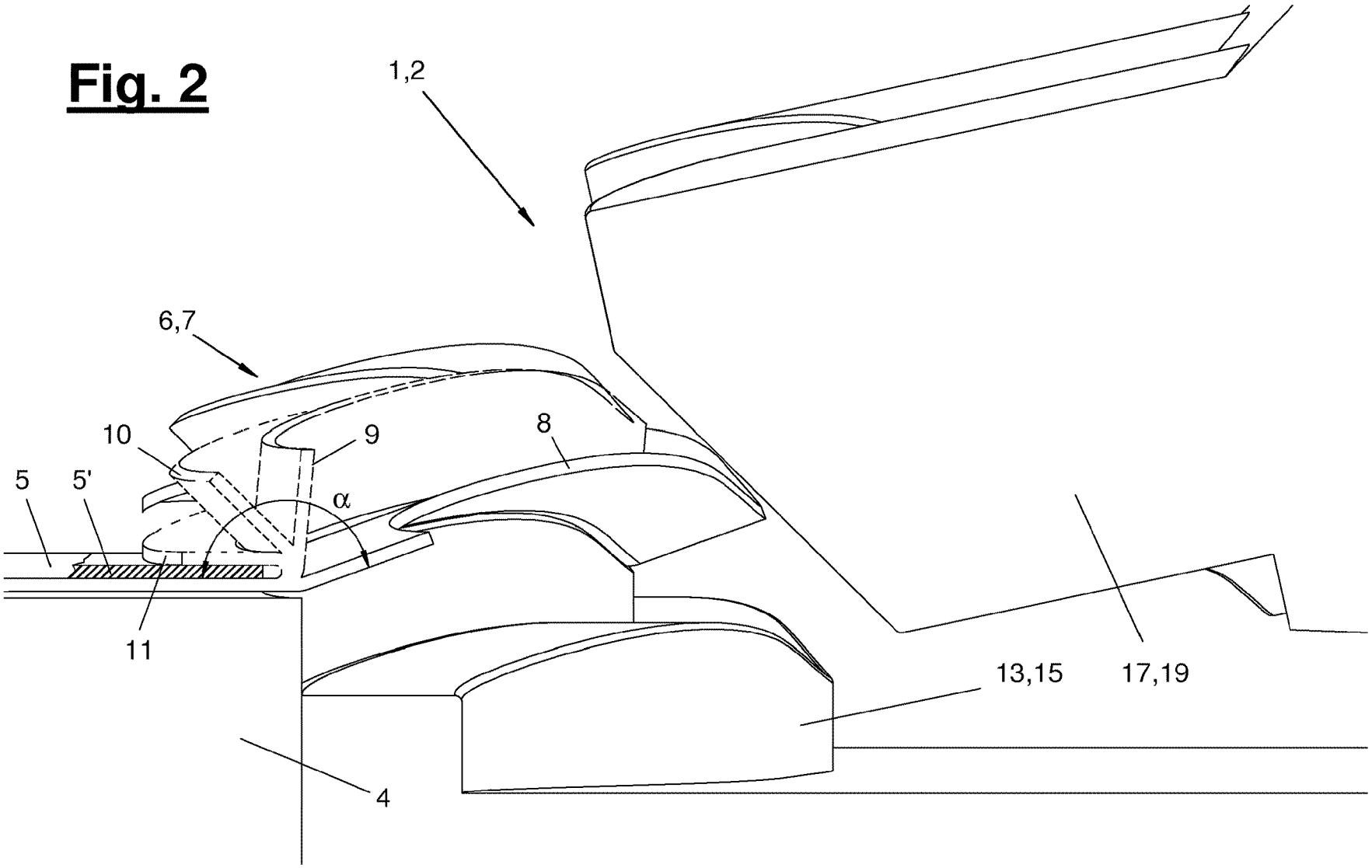
FIG. 2 is an enlarged view of the fold on a workpiece in different angular positions corresponding to the folding steps.

As is shown in FIG. 2, the fold (6) assumes an obliquely upwardly directed position in the starting position (8) in relation to the principal plane of the workpiece (5). The fold (6) now protrudes somewhat outwardly over the edge of the workpiece support (4) directed at right angles or obliquely to the principal plane of the workpiece.

In a first folding step, the fold (6) is bent into a more steeply upwardly directed intermediate position (9), especially an intermediate position directed at right angles to the principal plane of the workpiece. This first step is called prefolding step. In a next folding step, a so-called intermediate folding step, the fold (6) is bent more obliquely rearward in relation to the workpiece (5) into a sloped intermediate position (10). In the third folding step, the so-called finish folding step, the fold (6) is bent into the final position (11), in which it is aligned, e.g., parallel to the principal plane of the workpiece (5).

The fold angle ($\alpha$) is approximately 160° in FIG. 2. It may also be lower or greater than 160°. Special advantages over prior-art two-step folding tools arise in case of fold angles (?) exceeding 100°, especially 120°. A range that is preferred in practice for the fold angle ($\alpha$) is 120° to 180°. It may even be greater than 180° in special cases.

The three folding elements (13, 17, 21) are called prefolding element (13), intermediate folding element (17) and finish folding element (21), respectively. They are fed to the common folding point (7) at the workpiece (5) in the aforementioned three folding steps. They act on the same folding point (7) one after another and bend the fold during the above-mentioned folding steps during plastic deformation.

One folding element, preferably the prefolding element (13), performs a linear pushing motion. This happens during prefolding in the exemplary embodiment being shown. At least one other folding element (17, 21), preferably both folding elements (17, 21), perform a pivoting motion during folding. This happens during the intermediate folding and finish folding in the exemplary embodiment being shown.

The intermediate folding element (17) can perform a multiaxial motion during the folding process, and it is pivoted about a hinge or the axis (18') thereof, and this hinge (18') can, on the other hand, be displaced. This displacing motion may be a pivoting motion or a linear motion.

The folding tool (2) has a frame (12), which is supported in a suitable manner. It is preferably fastened laterally at the workpiece support (4). The folding elements (13, 17, 21) are mounted in an independently movable manner at the frame (12). The prefolding element (13) has a bearing (14), which is configured, e.g., as a sliding bearing. The bearing axis or motion direction is at right angles to the principal plane of the workpiece and is directed vertically in the embodiment and workpiece position.

The intermediate folding element (17) has a bearing (18), which is configured, e.g., as a multiaxially movable drag/sliding bearing. The bearing (18) is formed in the exemplary embodiment being shown by an adjusting device (41) movable relative to the frame (12), especially a pivoting lever, and an articulated connection (18') thereof to the intermediate folding element (17). Two pivoting motions with a horizontal axis (18', 45) are performed in this connection in the exemplary embodiment being shown.

As an alternative, the adjusting device (41) may be, e.g., a slide or have a different configuration and kinematics.

The finish folding element (21) has a bearing (22), which is configured, e.g., as a drag bearing secured on the frame with a horizontal axis.

The folding elements (13, 17, 21) are arranged one above another in the exemplary embodiment shown, the prefolding element (13) being arranged at the bottom, the intermediate folding element (17) in the middle and the finish folding element (21) at the top.

The folding elements may have any desired and suitable configuration, especially a one-part or multipart configuration. In the exemplary embodiments shown, they have each a folding jaw (15, 19, 23) with a folding contour appropriate for the process and with a jaw carrier (16, 20, 24). The jaw carrier (16, 20, 24) carries at its end the permanently or replaceably mounted folding jaw (15, 19, 23). At the other end area or at another point, the jaw carrier (16, 20, 24) is connected to the respective bearing (14, 18, 22) of the folding element (13, 17, 21).

Figure 7:
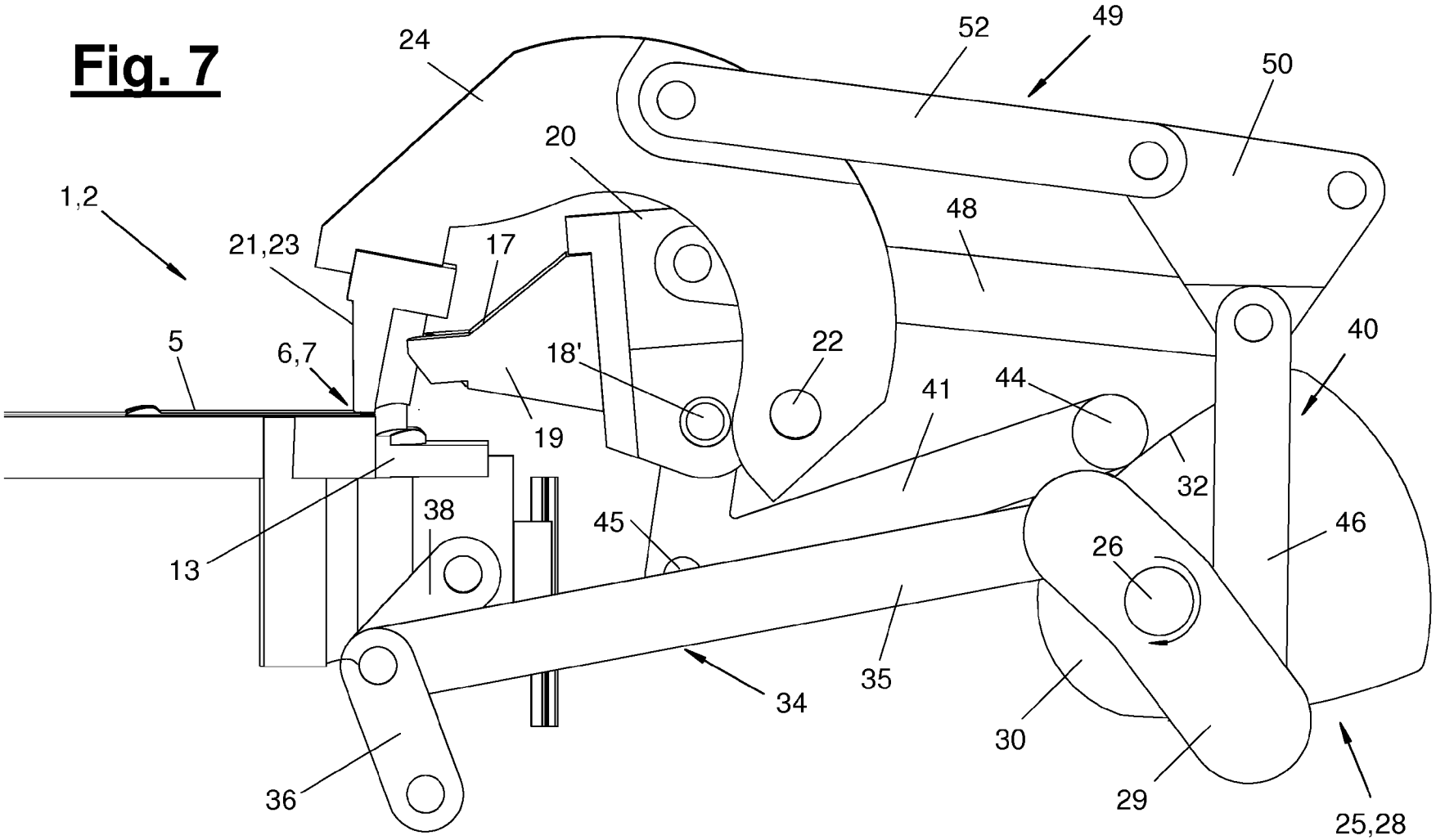
FIG. 7 is a lateral view showing the folding tool with folding elements in another of different operating and folding positions.

The jaw carriers (16, 20, 24) may have different shapes. The jaw carriers (16, 20) of the prefolding and intermediate folding elements (13, 17) may have a block-shaped configuration. The jaw carrier (24) of the finish folding element (21) has a bent shape, which extends from upwardly and in an arc towards the workpiece (5) from the bearing (22) located approximately at the level of the workpiece (5). Due to this configuration, the finish folding element (21) can extend over the intermediate folding element (17) in an arc from the rear and from the top and offers space for a retracted position of the intermediate folding element (17), which position is shown in FIG. 7.

The folding elements (13, 17, 21) preferably have a common drive (25). They may be driven jointly and simultaneously. The drive (25) may also be used to adjust the drag//sliding bearing (18).

The drive (25) has a driver (26)—comprises a driving means or propelling device (26), which is connected to a suitable drive device (not shown), e.g., a controllable or regulatable motor, especially an electric motor. The driver (26) is configured as a rotating drive shaft in the exemplary embodiment shown. The shaft axis is preferably oriented parallel to the axes of the bearings (18, 22). As an alternative, the driver may be configured as a push rod or in any other suitable manner.

The folding tool (2) further has a transmission (28) for transmitting the drive from the driver (26) to the folding elements (13, 17, 21). The transmission (28) may also act on the drag/sliding bearing (18). The transmission (28) is mounted and supported at the frame (12). The transmission (28) may have any desired and suitable configuration. It is configured as connecting rod mechanism in the exemplary embodiment.

The drive (25) further has a crank (29) connected to the driver (26). This crank (29) may be part of the transmission (28). In addition, the drive (25) has a rotating cam disk (30) connected to the driver (26) in the exemplary embodiment being shown. The connection is nonrotating and is used to actuate the drag/sliding bearing (18).

The cam disk (30) is configured as a cam mounted eccentrically on the drive shaft (26). This cam has an arc section (31) concentric with the axis of rotation with flank sections (32, 33) adjoining it on both sides and tapering conically towards the axis of rotation (26). The cam is rounded at the rear end located diametrically opposite the arc section. Said sections (31, 32, 33) have rounded transitions. They are located on the outer circumference of the cam. The arc section (31) is broader than the rear end of the cam. As an alternative, the cam disk (30) may have another suitable configuration.

The cam disk (30) is functionally connected to the drag/sliding bearing (18). The connection is such that the intermediate folding element (17) performs a multiaxial pivoting motion towards the fold (6) during the folding process and then a retracting motion.

This is brought about in the exemplary embodiment shown via a pivoting lever (41), which is pivotably connected, on the one hand, to the folding element (17) via the hinge (18'), and is coupled, on the other hand, with the cam disk (30), e.g., via a roller (44). The pivoting lever (41) is configured as an angle lever. It may have two lever arms (42, 43) of different lengths. The pivoting lever (41) has a lever mount (45), which is secured to the frame.

This lever mount is preferably located in the corner area or transition area between the lever arms (42, 43). The shorter lever arm (42) extends from the lever mount (45) to the intermediate folding element (17), especially to the jaw carrier (20) and to the hinge (18') located there. The longer lever arm (43) extends from the lever mount (45) to the roller (44) and to the cam disk (30).

The transmission (28), preferably the connecting rod mechanism shown, has a plurality of preferably jointly driven transmission groups (34, 40, 49). These are three transmission groups in the exemplary embodiment being shown, a transmission group (34, 40, 49) each being associated with each folding element (13, 17, 21). One or more, preferably all transmission groups (34, 40, 49) are configured as toggle mechanisms. They are connected to the rotatorily driven crank (29) and generate strong folding forces.

The mutual association of the transmission groups (34, 40, 49) and the connection thereof to the crank (29) may have different configurations. They may each have a crank connection of their own, e.g., as in the transmission group (34). At least two transmission groups (40, 49) are coupled directly with one another in the exemplary embodiment shown. As a result, their motions are dependent on one another and are coordinated with one another. The coupling preferably pertains to the transmission groups (40, 49) for the intermediate and finish folding.

One transmission group (34) for the prefolding has a driving rod (35), which is configured, e.g., as a push rod. The driving rod (35) is arranged horizontally and is connected at one end to the crank (29) in an articulated manner and is connected to two toggle levers (36, 38) via a hinge (39) at the other end. The toggle levers (36, 38) act on the lower folding element (13), especially the prefolding element. They move it up and down corresponding to the position of the push rod along the sliding bearing (14). The lower toggle lever (36) is mounted rotatably at a lever mount (37) secured to the frame. The upper toggle lever (38) is connected to the folding element (13), especially to the jaw carrier (16) thereof, in an articulated manner.

Another transmission group (40), especially for the intermediate folding, has a tie rod (46), a pivoting lever (50) and a driving rod (48), which are each connected at the end to one another via a hinge (47). The tie rod (46) is connected at the other end to the crank (29) in an articulated manner. The drive rod (48) is connected at its other end to the folding element (17), especially to the jaw carrier (20) thereof, in an articulated manner. The pivoting lever (50) is configured as a wishbone in the exemplary embodiment shown. It has a lever mount (51) secured on the frame.

The third transmission group (49), especially for the finish folding, has a driving rod (52) and said pivoting lever (50), which are connected to one another in an articulated manner. The driving rod (52) is connected at the other end to the folding element (21), especially to the jaw carrier (24) thereof, in an articulated manner. The rods (35, 46, 48, 52) are preferably configured as straight and slim rods. The pivoting lever (50) is shared by the two transmission groups (40, 49) and couples these. The mount (51), which is secured on the frame, the hinge (47) and the articulation point of the driving rod (52) are spaced apart from one another and are each arranged at a corner area of the triangular lever (50).

The function and the motion sequence of the folding tool (2) will be described below.

Figure 3:
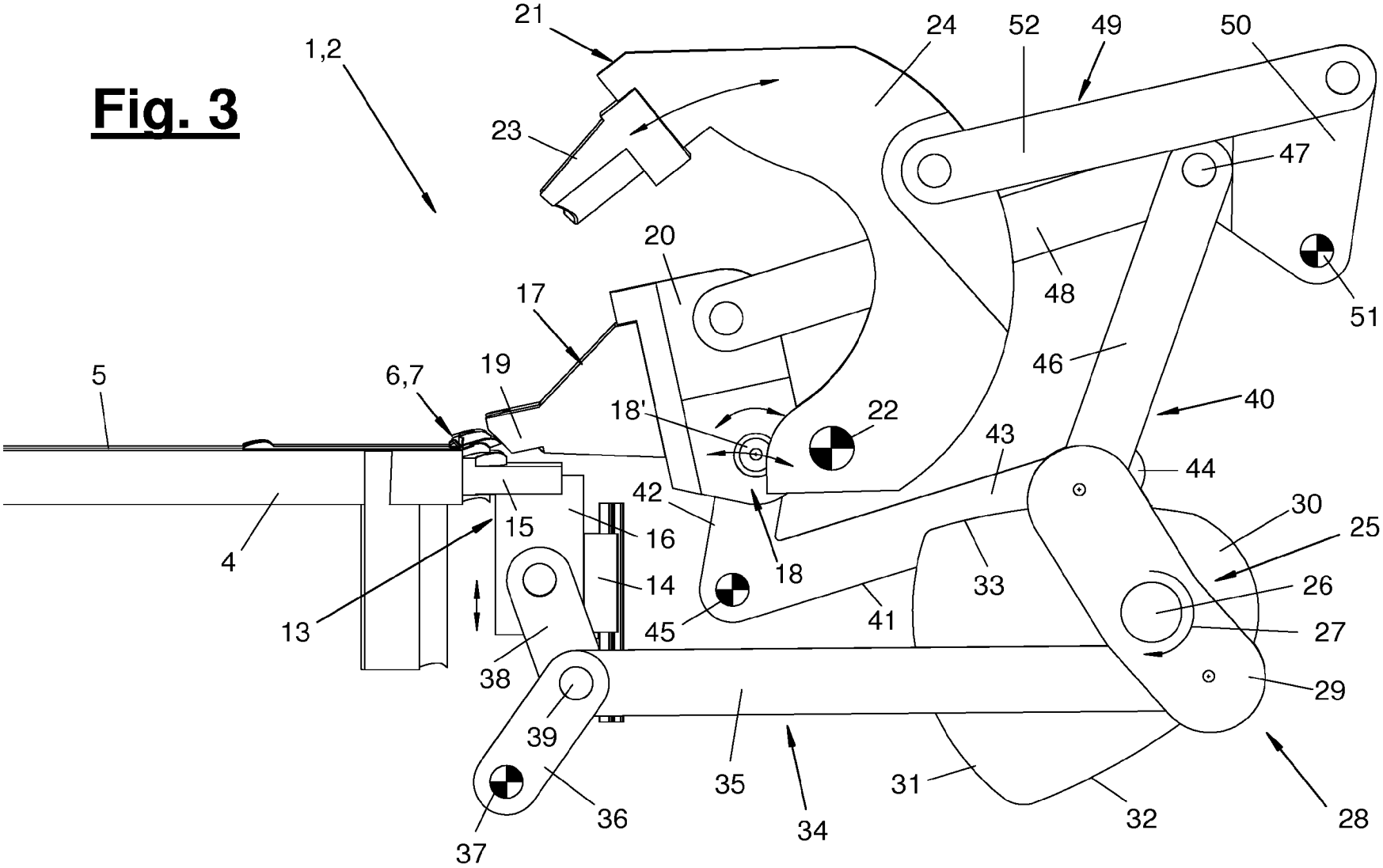
FIG. 3 is a lateral view showing the folding tool with folding elements in one of different operating and folding positions.

FIG. 3 shows the starting position of the folding tool (2) and of the parts thereof. The same position is also shown in FIG. 1. The frame (12) is not shown in FIG. 3 for the sake of clarity.

Figure 4:
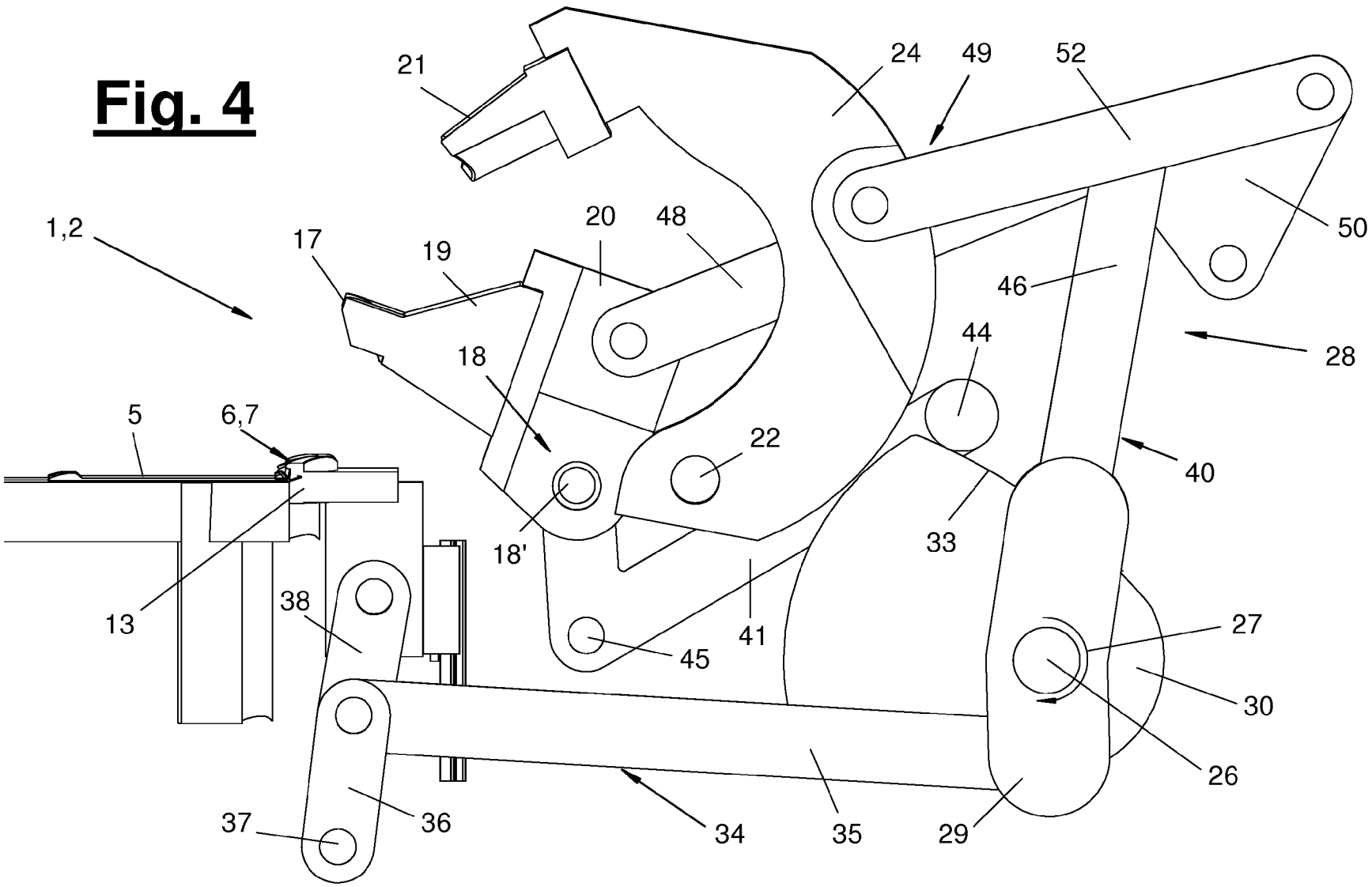
FIG. 4 is a lateral view showing the folding tool with folding elements in another of different operating and folding positions.
Figure 8:
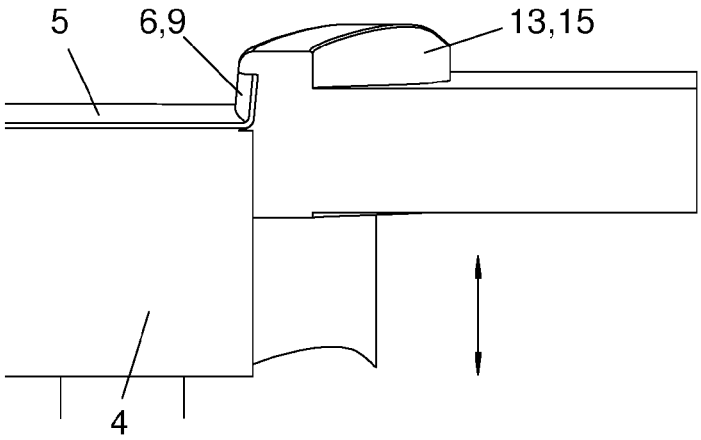
FIG. 8 is an enlarged detail view of the fold for the operating and folding positions shown in FIG. 7.

The drive shaft (26) is rotated in the rotation direction (27) from the starting position, and the crank (29) and the cam disk (30) are moved along in a rotationally engaged manner. This rotary motion first leads according to FIG. 4 to a retracting motion of the middle and upper folding elements (17, 21) and to a feed motion of the lower folding element (13). The crank (29) pushes the push rod (35) in the direction of the folding bed (4) and to the workpiece (5), while the toggle levers (36, 38) move from the initial bent position into the stretched position shown in FIG. 4 and push the prefolding element (13) upward as a result. The fold (6) is bent hereby into the above-mentioned first and upright intermediate position (9). FIG. 8 shows this position of the folding jaw (15) and the folded position (9).

The angle lever (41) with the roller (44) is in contact with a flank section (33) during the above-mentioned initial rotation of the drive shaft (26). Due to its rotation, the angle lever (41) is rotated counterclockwise about its mount (45), which is secured on the frame. On the other hand, the intermediate folding element (17) is rotated clockwise via the transmission group (40) about its hinge (18') at the angle lever (41). The two rotary or pivoting motions are superimposed to one another, as a consequence of which the folding jaw (19) is moved away from the fold (6) and is tilted rearward.

The finish folding element (21) is likewise pivoted clockwise rearward into said retracted position via its transmission group (49). The finish folding element (21) may optionally also maintain its starting position, in which case the motions of the driving rod (52) and of the pivoting lever (50) neutralize each other.

Figure 5:
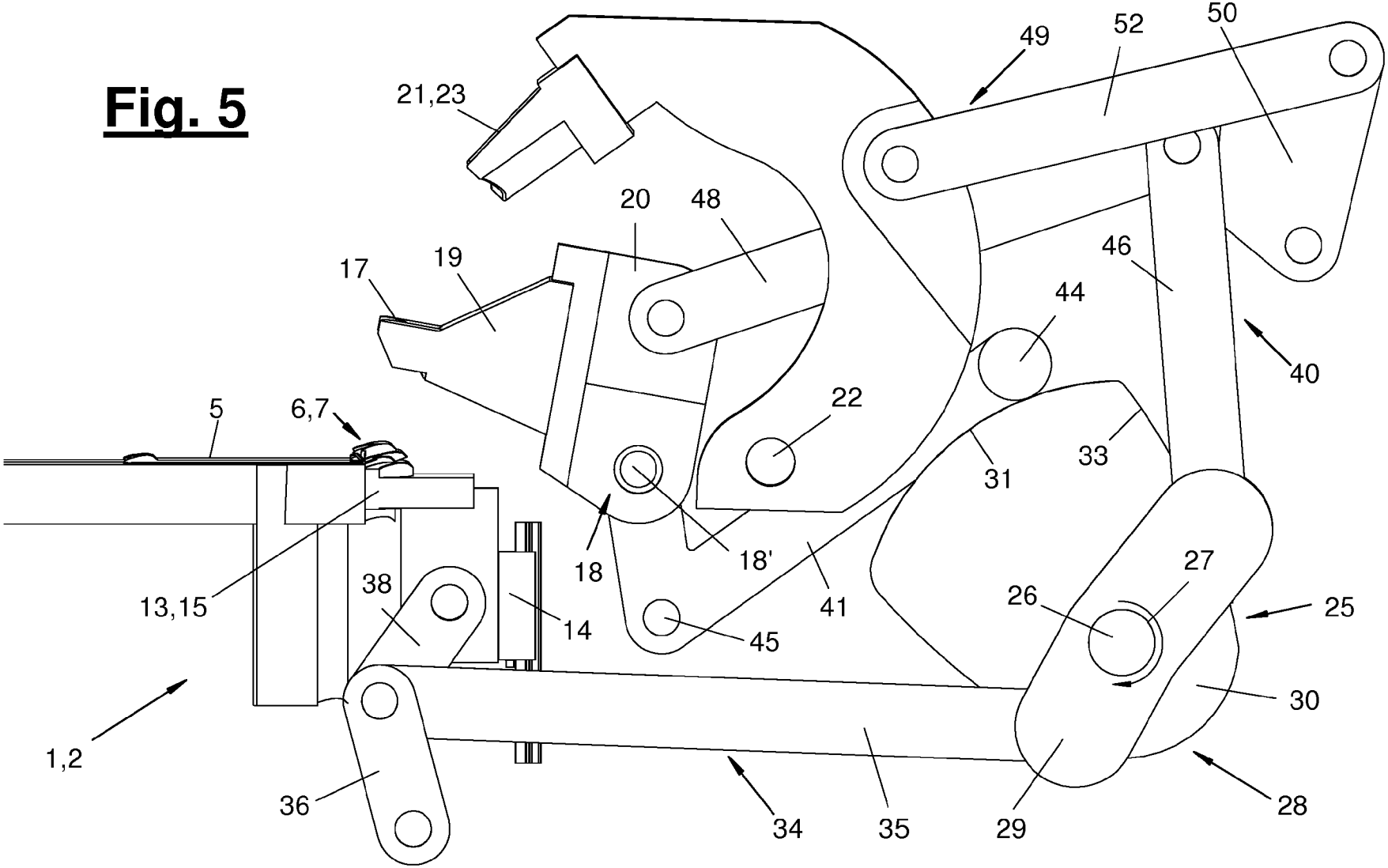
FIG. 5 is a lateral view showing the folding tool with folding elements in another of different operating and folding positions.

FIG. 5 shows a next rotated position of the drive (25) and of the drive shaft (26). The toggle levers (36, 38) of the transmission group (34) again assume a bent position, which is directed towards the starting position. The prefolding element (13) is again lowered due to the bent position.

Due to the further rotation of the cam disk (30), the roller (44) of the angle lever (41) reaches the concentric arc section (31). The consequence of this is that the angle lever (41) is supported during the further rotary motion of the cam disk (30) and it maintains its position shown in FIG. 5. As a result, the hinge (18') is also fixed between the angle lever (41) and the intermediate folding element (17). Due to the preceding pivoting motion of the angle lever (41), this hinge (18') is moved or displaced towards the fold (6) and assumes the maximally approached position.

Figure 6:
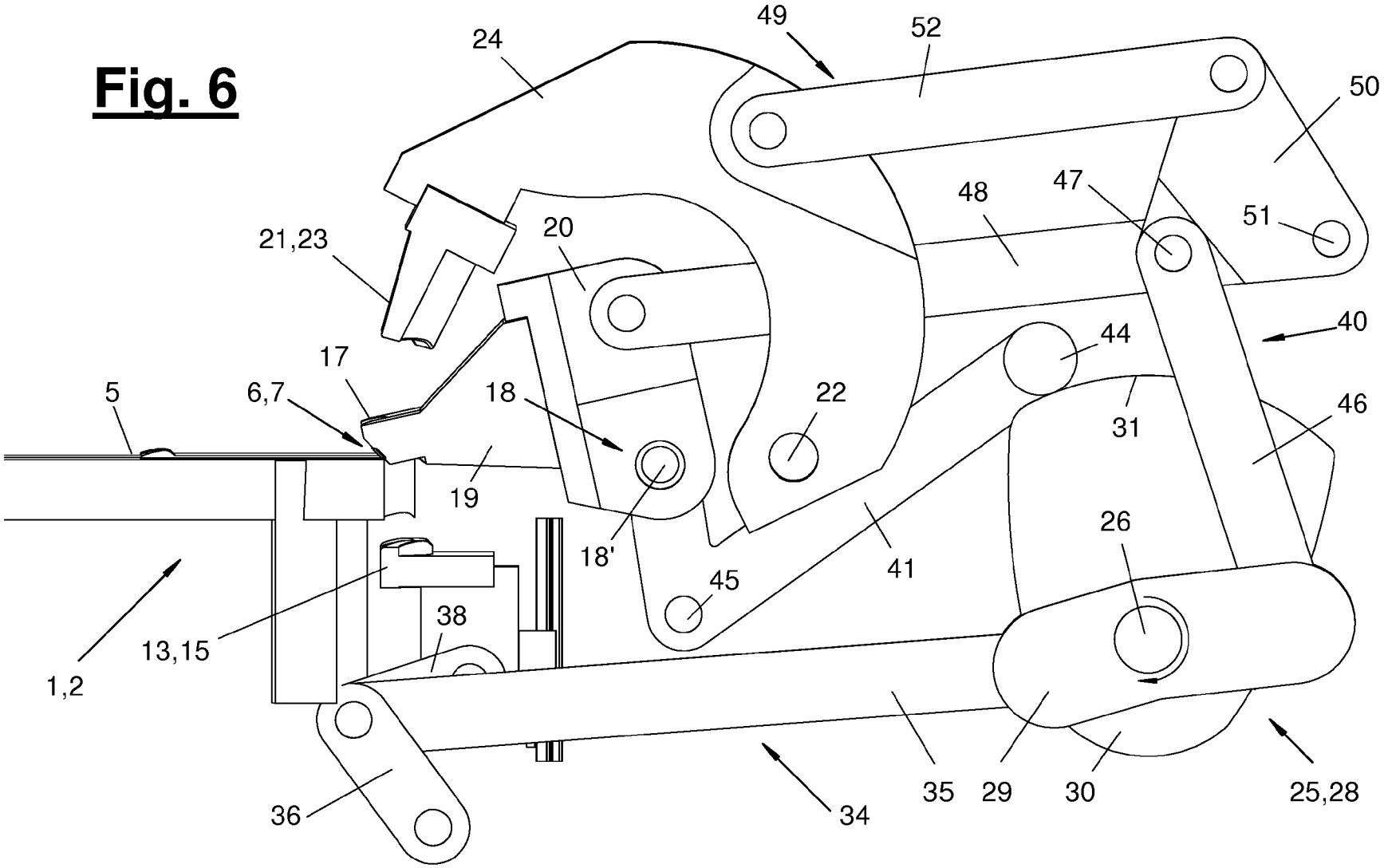
FIG. 6 is a lateral view showing the folding tool with folding elements in another of different operating and folding positions.
Figure 9:
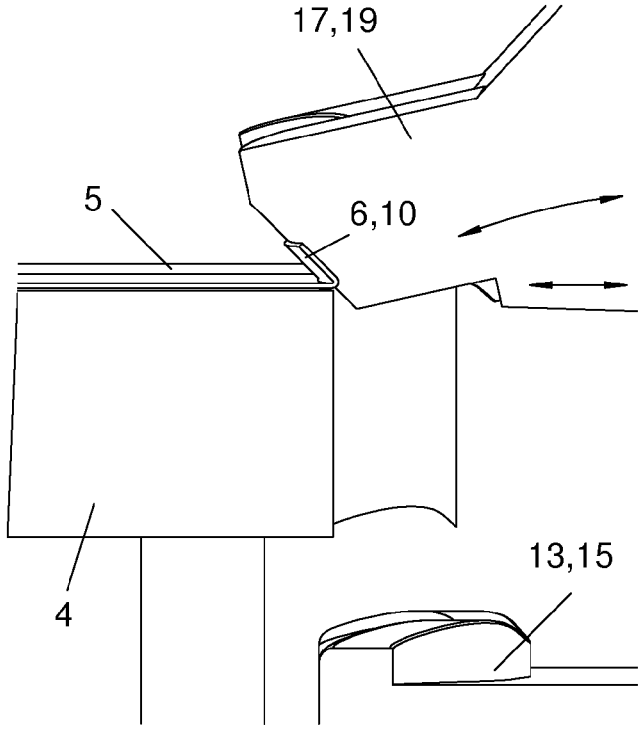
FIG. 9 is another enlarged detail view of the fold for the operating and folding positions shown in FIG. 7.

The intermediate folding step will subsequently take place from the operating position of the folding tool (2), which position is shown in FIG. 5, and the intermediate folding element (17) is pivoted down via the further driving rotation of the intermediate folding element (17) according to FIG. 6 and is pressed with the folding jaw (19) against the fold (6) located in the upright folded position (9) and bends this into the oblique folded position or intermediate position (10). FIG. 9 shows this folded and jaw position.

The angle lever (41) and the drag/sliding bearing (18) are held stationary during the intermediate folding step, and the intermediate folding element (17) is pivoted about the hinge (18') in the manner described due to the action of the transmission group (40) with the rod (46) and with the driving rod. The rods (46, 48) act as toggle levers now. The prefolding element (13) has been lowered even further by its transmission group (34).

FIG. 7 shows the finish folding step, in which the intermediate folding element (17) is removed from the fold (6) and assumes a retracted position. The hinge (18') had been removed for this from the workpiece (5) and moved back. Due to the roller (44) now sliding on the other flank section (32), the angle lever (41) will have been pivoted clockwise, and the transmission group (40) also brings about a clockwise pivoting-back motion of the intermediate folding element (17) about the displaced hinge (18').

Figure 10:
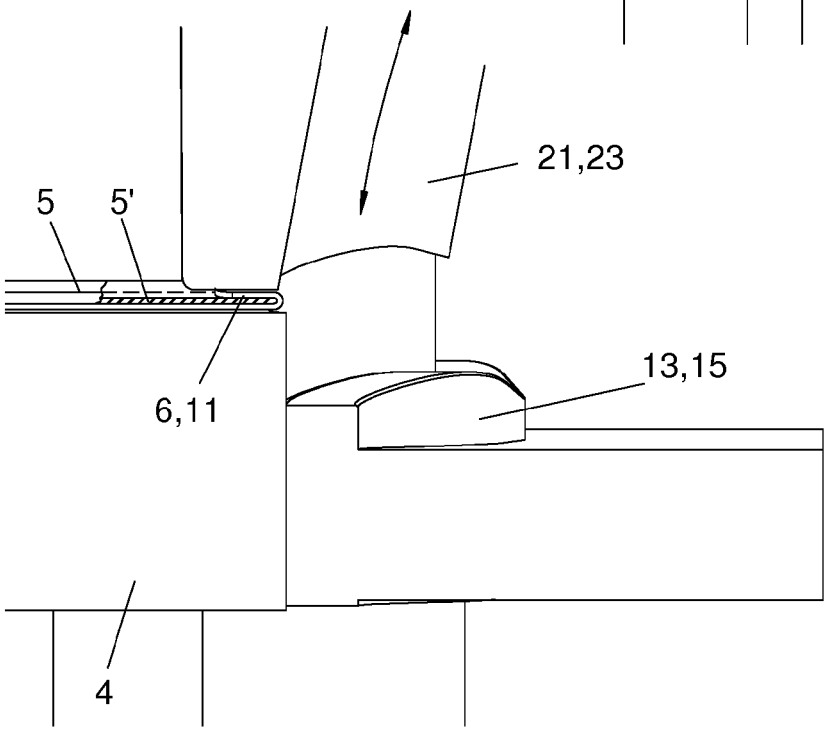
FIG. 10 is another enlarged detail view of the fold for the operating and folding positions shown in FIG. 7.

The transmission group (49) brings about a counterclockwise pivoting motion of the finish folding element (21) about the bearing (22) into the folded position shown during the finish folding. As is shown in FIG. 10, the folding jaw (23) now bends the fold (6) out of the intermediate position (10) into the final position (11). The folding jaw (23) can now extend over the intermediate folding element (17).

The lower folding element (13) has moved beyond the lower dead center of its displacing motion shown in FIG. 6 and is again performing an upward motion. The folding jaw (15) is still positioned now under the fold (6). After a further rotation of the drive shaft (26), the folding elements (13, 17, 21) assume again the starting position shown in FIGS. 1 and 3. The toggle levers (36, 38) can now move once again over their stretched position. All folding elements (13, 17, 21) are in their retracted positions in this starting position, so that the folded workpiece (5) is exposed and can be replaced.

Various modifications of the embodiments shown and described are possible. The transmission (28) may also have another configuration. It may have, e.g., rolling parts. The groups of the transmission parts may also be formed differently and divided into groups differently. The transmission (28) may also have a different kinematics. This also applies to the arrangement and the function of the folding elements (13, 17, 21). The arrangement and the kinematics of the bearings (14, 18, 22) are variable as well. In one variant, they may all be pivotable. In another variant, the prefolding element (13) may be pivotable, and the intermediate and/or finish folding element (17, 21) is linearly displaceable. The number of folding elements and of the folding steps may be greater than three. Instead of a common, single drive (25), a plurality of drives and drivers (26) may be present, which will then only be connected to only one or a few of the transmission groups each. Further, the workpiece position may be different and may have, e.g., a vertical direction component. The aforementioned orientations of the folding tool (2) and of the parts thereof will then also change correspondingly.

Further, the features of the above-described exemplary embodiments and variants may be combined with one another as desired, and especially also be transposed.

While specific embodiments of the invention have been shown and described in detail to illustrate the application of the principles of the invention, it will be understood that the invention may be embodied otherwise without departing from such principles.

The invention claimed is:

1. A folding tool for bend folding a workpiece in multiple steps, the folding tool comprising:

a plurality of driven folding elements, which can be fed to a common folding point, the plurality of driven folding elements comprising three or more folding elements arranged one above another, wherein at least one folding element performs a pivoting motion; and a common drive, wherein the plurality of driven folding elements are driven by the common drive, wherein the common drive comprises a rotating drive shaft connected to a transmission for drive transmission to the folding elements.

2. A folding tool in accordance with claim 1, wherein the folding tool is provided and configured for a fold angle greater than 100°.

3. A folding tool in accordance with claim 1, wherein the folding elements can be fed to the common folding points consecutively in a plurality of folding steps.

4. A folding tool in accordance with claim 1, wherein:

one folding element of the plurality of driven folding elements is for prefolding, and performs a linear pushing motion; and the at least one folding element that performs a pivoting motion is an intermediate folding, folding element or a finish folding, folding element or both an intermediate folding and finish folding, folding element.

5. A folding tool in accordance with claim 1, wherein the common drive is a consecutive drive.

6. A folding tool in accordance with claim 1, further comprising a frame, on which the folding elements are mounted in an independently movable manner, wherein the folding elements have a folding jaw each with a jaw carrier and with a bearing.

7. A folding tool in accordance with claim 1, wherein:

one of the folding elements is one for prefolding and has a sliding bearing;

one of the folding elements is for intermediate folding and has a drag/sliding bearing; and one of the folding elements is for finish folding and has a drag bearing.

8. A folding tool in accordance with claim 1, wherein the transmission is configured as a connecting rod mechanism.

9. A folding tool in accordance with claim 8, wherein:

the transmission connecting rod mechanism, has three transmission groups; and one of the three transmission groups is associated with each of the folding elements.

10. A folding tool in accordance with claim 1, wherein the drive has a crank connected to the rotating drive shaft.

11. A folding tool in accordance with claim 1, wherein the drive has a rotating cam disk connected to the rotating drive shaft.

12. A folding tool in accordance with claim 11, wherein:

one of the folding elements has a drag/sliding bearing; and the cam disk is functionally connected to the drag/sliding bearing of one of the folding elements such that another of the folding elements performs a pivoting motion during the folding and then a retracting motion.

13. A folding device for bend folding a workpiece in multiple steps, the folding device comprising:

a workpiece support comprising a folding bed; and a folding tool with a plurality of driven folding elements, which can be fed to a common folding point, the folding tool comprising:

a plurality of driven folding elements, which can be fed to a common folding point, the plurality of driven folding elements comprising three or more folding elements arranged one above another, wherein at least one folding element performs a pivoting motion; and a common drive, wherein the plurality of driven folding elements are driven by the common drive, wherein the common drive comprises a rotating drive shaft connected to a transmission for drive transmission to the folding elements.

14. A folding device in accordance with claim 13, further comprising a holding-down device for the workpiece wherein the folding tool is supported on the workpiece support.

15. A folding device in accordance with claim 13, wherein the transmission is configured as a connecting rod mechanism.

16. A folding tool in accordance with claim 15, wherein:

the transmission configured as a connecting rod mechanism comprises three transmission groups; and one of the three transmission groups is associated with each of the folding elements.

17. A folding device in accordance with claim 13, wherein the common drive has a crank connected to the rotating drive shaft.

18. A folding device in accordance with claim 13, wherein the common drive has a rotating cam disk connected to the rotating drive shaft.

19. A folding device in accordance with claim 18, wherein:

one of the folding elements has a drag/sliding bearing; and the cam disk is functionally connected to the drag/sliding bearing of one of the folding elements such that another of the folding elements performs a pivoting motion during the folding and then a retracting motion.

* * * * *